United States Patent [19]

Honjo

[11] Patent Number: 4,613,227

[45] Date of Patent: Sep. 23, 1986

[54] IMAGE FORMING APPARATUS

[75] Inventor: Takeshi Honjo, Tokyo, Japan

[73] Assignee: Canon Kabushiki Kaisha, Tokyo, Japan

[21] Appl. No.: 463,293

[22] Filed: Feb. 2, 1983

[30] Foreign Application Priority Data

Feb. 8, 1982 [JP] Japan ..... 57-18412
Feb. 8, 1982 [JP] Japan ..... 57-18413

[51] Int. Cl.[4] ..... G03G 15/00

[52] U.S. Cl. ..... 355/14 C; 355/3 SH; 355/3 R; 355/14 R

[58] Field of Search ..... 355/3 SH, 14 SH, 3 R, 355/14 R, 14 TR, 3 TR, 14 C

[56] References Cited

U.S. PATENT DOCUMENTS 4,139,300 2/1979 Katayama et al. ..... 355/14 R
4,279,504 7/1981 Brown et al. ..... 355/3 SH X
4,366,219 12/1982 Beery ..... 355/14 SH X
4,382,674 5/1983 Miyoshi et al. ..... 355/14 R X
4,395,111 7/1983 Takahashi et al. ..... 355/14 SH X
4,455,080 6/1984 Sugiura et al. ..... 355/14 SH
4,455,081 6/1984 Yoshimura et al. ..... 355/14 SH
4,468,113 8/1984 Motohashi et al. ..... 355/14 TR

*Primary Examiner*—A. C. Prescott
*Attorney, Agent, or Firm*—Fitzpatrick, Cella, Harper & Scinto

[57] ABSTRACT

The invention provides an image forming apparatus which performs continuous copying operation without degrading the quality of copies. The apparatus includes a photosensitive drum for forming an image thereon, pressure fixing rollers for fixing the transferred image on the transfer paper sheet, a detection switch for detecting the trailing edge of the transfer paper sheet, and timers T0 to T5 assigned in a RAM of a microcomputer μCOM of a control section. The timers function such that the conveyance of the transfer paper sheet for the next copying operation is prohibited until the current transfer paper sheet is completely fed out, thereby preventing an adverse effect of an impact by the pressure/-fixing rollers.

12 Claims, 6 Drawing Figures

IMAGE FORMING APPARATUS

BACKGROUND OF THE INVENTION

1. Field of the Invention

The present invention relates to an image forming apparatus such as a copying machine.

2. Description of the Prior Art

In a conventional copying machine having a fixing unit, when a transfer paper bearing a toner image is passed through the fixing unit, and especially when the transfer paper is conveyed out of a fixing unit, the return movement of a pair of rollers housed in the fixing unit, to which a certain degree of pressure is applied, may cause an impact. This adversely and seriously affects the fixing unit. Especially when a system for driving the rollers is incorporated with at least one of a scanning system of an original, a system for driving a photosensitive drum, and a system for conveying transfer paper, such as impact prevents a normal copying process so that blurs and the like occur, thus degrading the quality of a copy.

A transfer unit comprising a transfer roller and so on whose drive is controlled is also subject to the same problem. Furthermore, in a compact machine in which a transfer section and a feed paper section are located close to each other, if a feed paper operation is started before the previous transfer operation is completed, a transfer blur may occur.

SUMMARY OF THE INVENTION

It is an object of the present invention to provide an image forming apparatus which eliminates the drawbacks of the conventional apparatuses described above.

It is another object of the present invention to provide an image forming apparatus which can produce a high quality copy.

It is still another object of the present invention to provide an improved image forming apparatus which allow continuous copying.

It is still another object of the present invention to provide an image forming apparatus which allows continuous high-quality copying without degrading the copying speed.

It is still another object of the present invention to provide an image forming apparatus having an improved sequence control mechanism for each image forming mode.

The above and other objects of the present invention will become apparent from the following description taken in conjunction with the accompanying drawings.

DETAILED DESCRIPTION OF THE PREFERRED EMBODIMENTS

The embodiments of the present invention will now be described with reference to the drawings.

Figure 1:
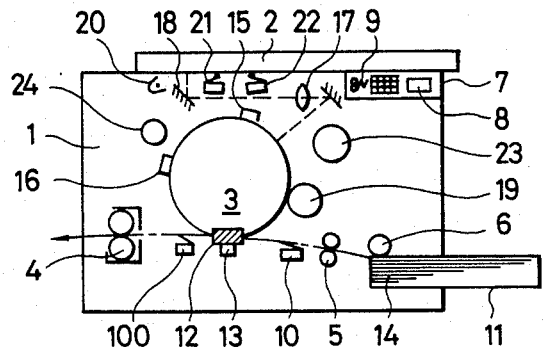
FIG. 1 schematically shows the configuration of a copying machine according to a first embodiment of the present invention.

FIG. 1 schematically shows the configuration of a copying machine according to a first embodiment of the present invention. The copying machine has a copying machine main body 1. An original is placed on a reciprocable original table 2. A rotatable photosensitive drum 3 has a photosensitive layer formed therearound. A driving motor 23 serves to drive a driving system to be described later. A forward/backward clutch 24 controls the reciprocal movement of the original table 2. An exposure lamp 20 for exposing an image to form an electrostatic latent image of the original on the photosensitive drum 3. A development roller 19 develops the electrostatic latent image. A transfer charger 13 transfers the developed image onto a transfer paper sheet 14. A charger 15 charges the surface of the photosensitive drum 3. A charge remover 16 removes residual charge from the photosensitive drum 3. A separation mechanism 12 separates the transfer paper sheet 14 with the image from the surface of the phtotosensitive drum 3. A cassette 11 for storing transfer paper sheets 14 is removably arranged in the main body 1. A feed paper roller 6 feeds a transfer paper sheet 14 from the cassette 11. Pressure/fixing rollers 4 are provided for fixing the image on the transfer paper sheet 14 by the application of pressure. Waiting rollers 5 start rotating in response to a signal from a timing switch 21 when the original table 2 moves forward. A lens 17 is for forming an image on the surface of the photosensitive drum 3 by passing light therethrough from the exposure lamp reflected by the original. A definite position switch 22 detects whether the original table 2 is at a predetermined or definite position. A detection switch 10 detects the transfer paper sheet 14 and performs paper size detection and a paper jam detection. A control panel 7 has a copy start switch 8 and a jam indicator 9 mounted thereon.

Figure 2:
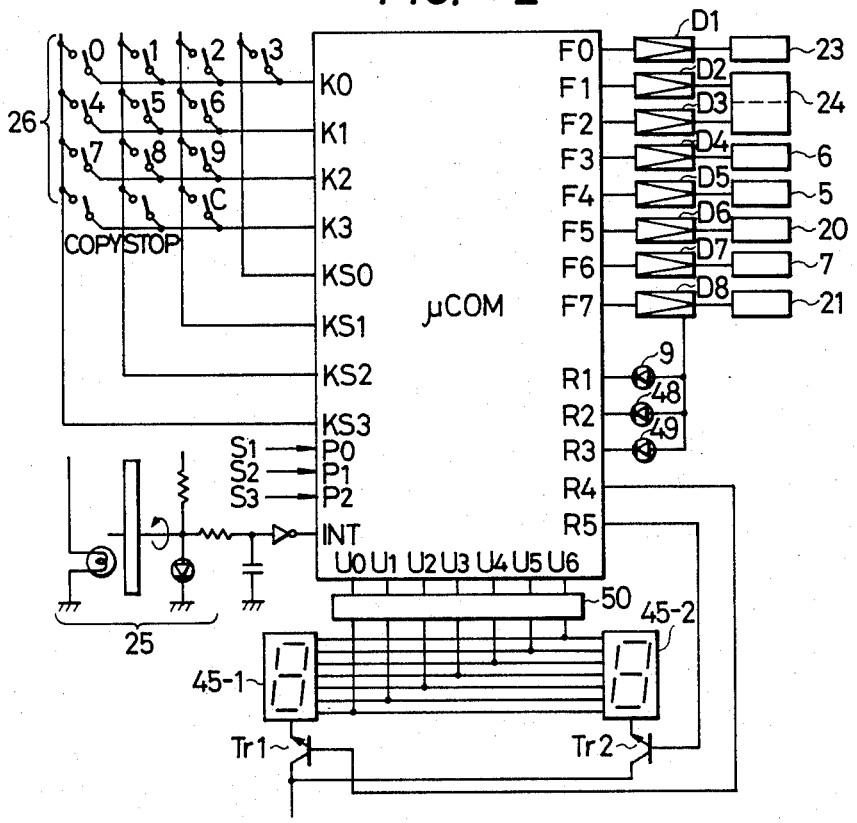
FIG. 2 is a control circuit diagram of a copying machine according to the first embodiment of the present invention.

FIG. 2 is a circuit diagram for explaining a control section of the copying machine. A known one-chip microcomputer μCOM may be used, for example, a μPD 546 manufactured by Nippon Electric Co., Ltd. An interruption port INT is supplied with pulse signals which are generated by a drum clock generator 25 upon rotation of the photosensitive drum 3 and which are waveform-shaped by a capacitor. Seven-segment display elements 45-1 and 45-2 indicate the number of tens and the number of units, respectively, of a value which indicates the number of copies to be produced. Amplifier transistors Tr1 and Tr2 are respectively connected to the 7-segment display elements 45-1 and 45-2. The display elements 45-1 and 45-2 are respectively connected to segment selection output ports U0 to U6 through driver 50 and dynamically display the number of copies to be produced in response to digit selection signals from output ports R4 and R5, respectively. Indicators 9, 48 and 49 light up when they detect a paper jam, no paper and no toner, respectively, and are controlled by output signals from output ports R1 to R3. Time division signals from output ports KS0 to KS3 scan ten keys for designating the number of copies, a clear key, and so on, so that signals for representing the statuses of these keys are supplied as dynamic input to input ports K0 to K3.

Signals S1 to S3 from the detection switch 10, the timing switch 21 and the definite position switch 22, respectively, are supplied to input ports P0 to P2, respectively. A driving signal for the driving motor 23, an original table forward clutch driving signal for the forward/backward clutch 24, an original table backward clutch driving signal for the forward/backward clutch 24, a driving signal for the feed paper roller 6, a driving signal for the waiting rollers 5, a light-up signal for the exposure lamp 20, a driving signal for the development roller 19 and a driving signal for a high-voltage transformer 27 are produced from output ports F0 to F7 through drivers D1 to D8, respectively, in accordance with input signals for the microcomputer μCOM.

The driving motor 23 shown in FIG. 1 serves as a driving source for the driving system of the photosensitive drum 3, the forward/backward clutch 24 for moving the original table forward and backward, the development roller 19, the feed paper roller 6, the waiting (or registor) rollers 5, the separation mechanism 12 and the pressure/fixing rollers 4, and is connected to these by chains, timing belts and so on (not shown). Timers Tϕ to T5 are incorporated in a RAM of the microcomputer μCOM.

Figure 3A:
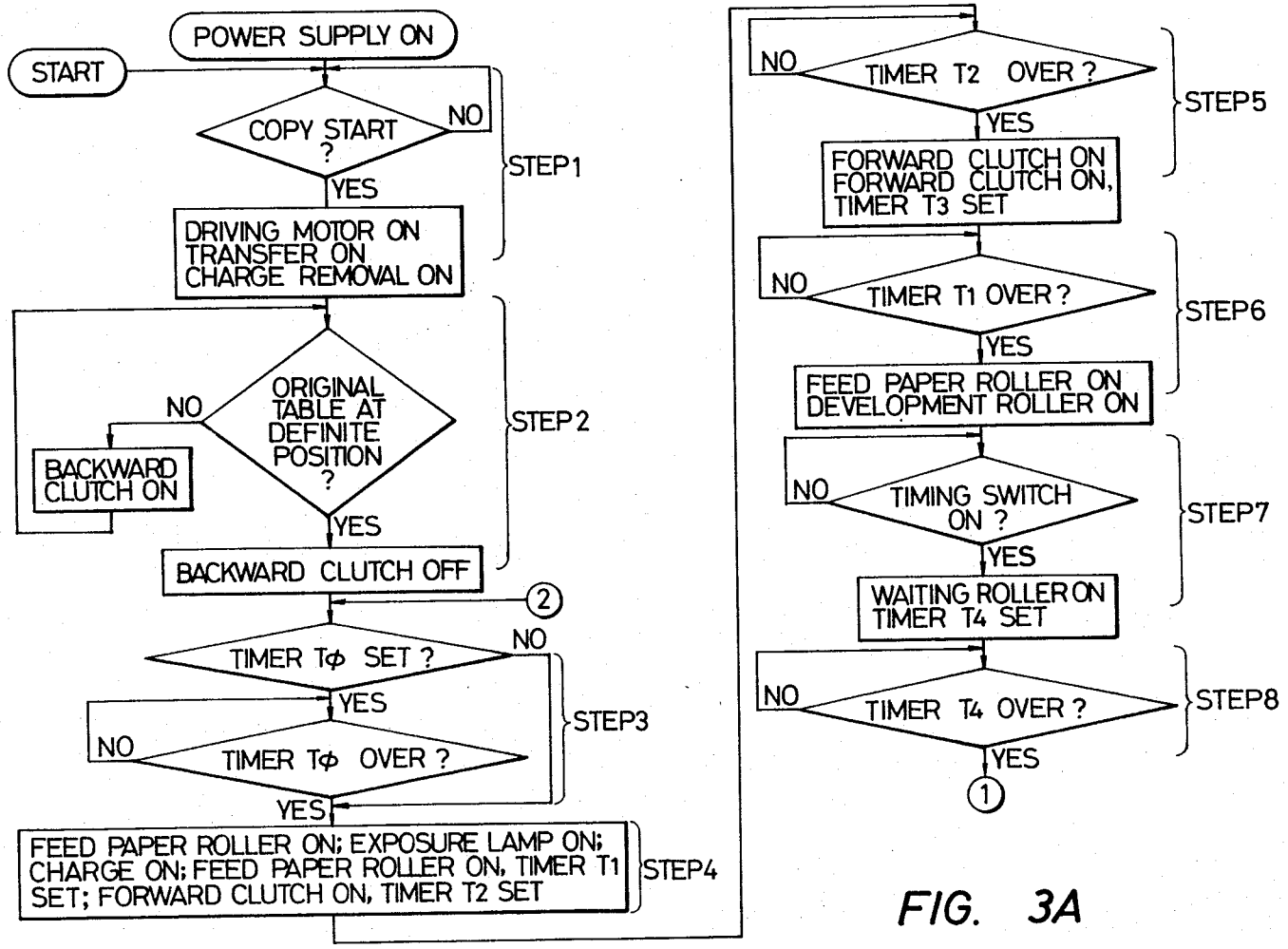
FIGS. 3A and 3B show flowcharts of a copying machine operation according to the first embodiment of the present invention.
Figure 3B:
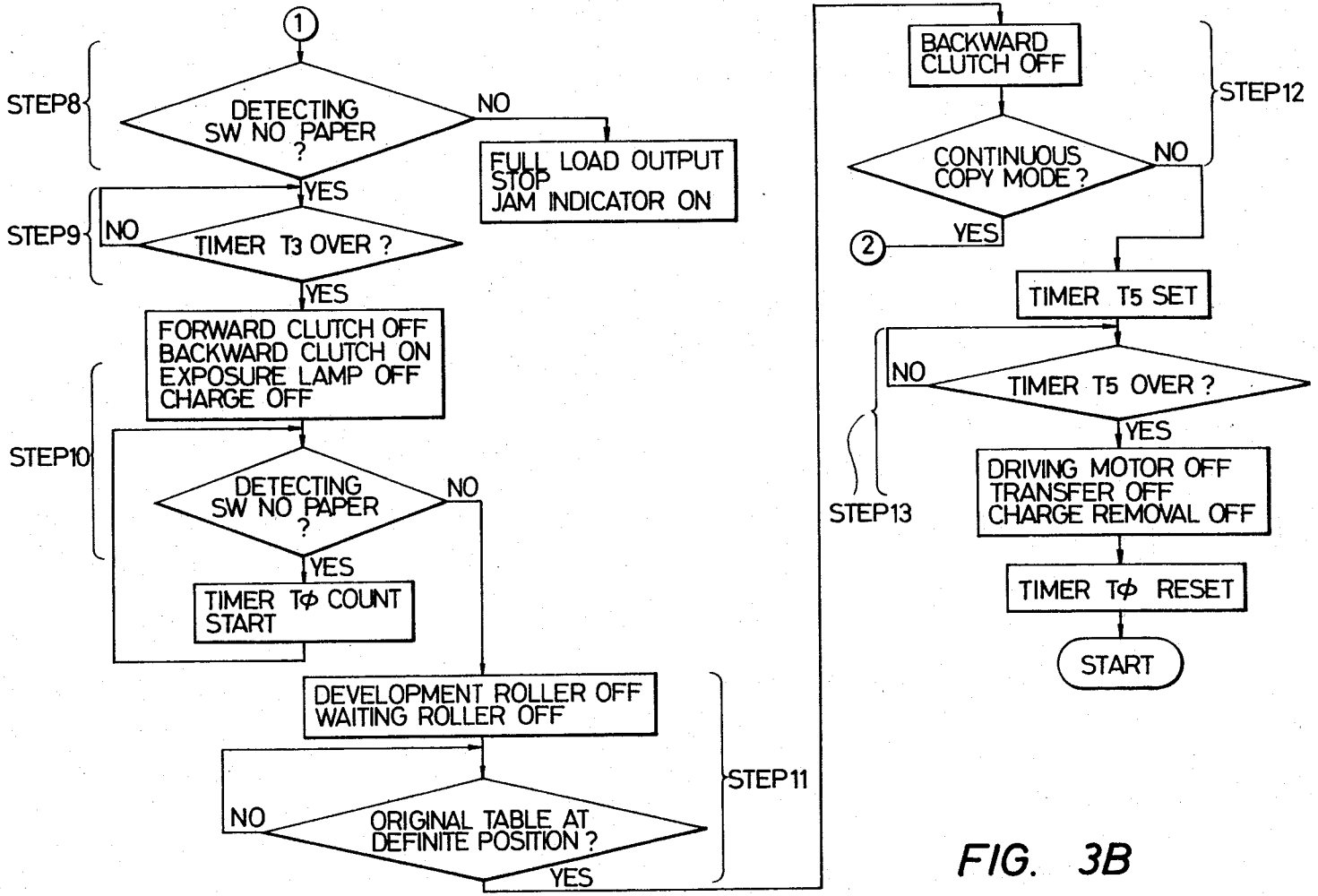
Figure 4:
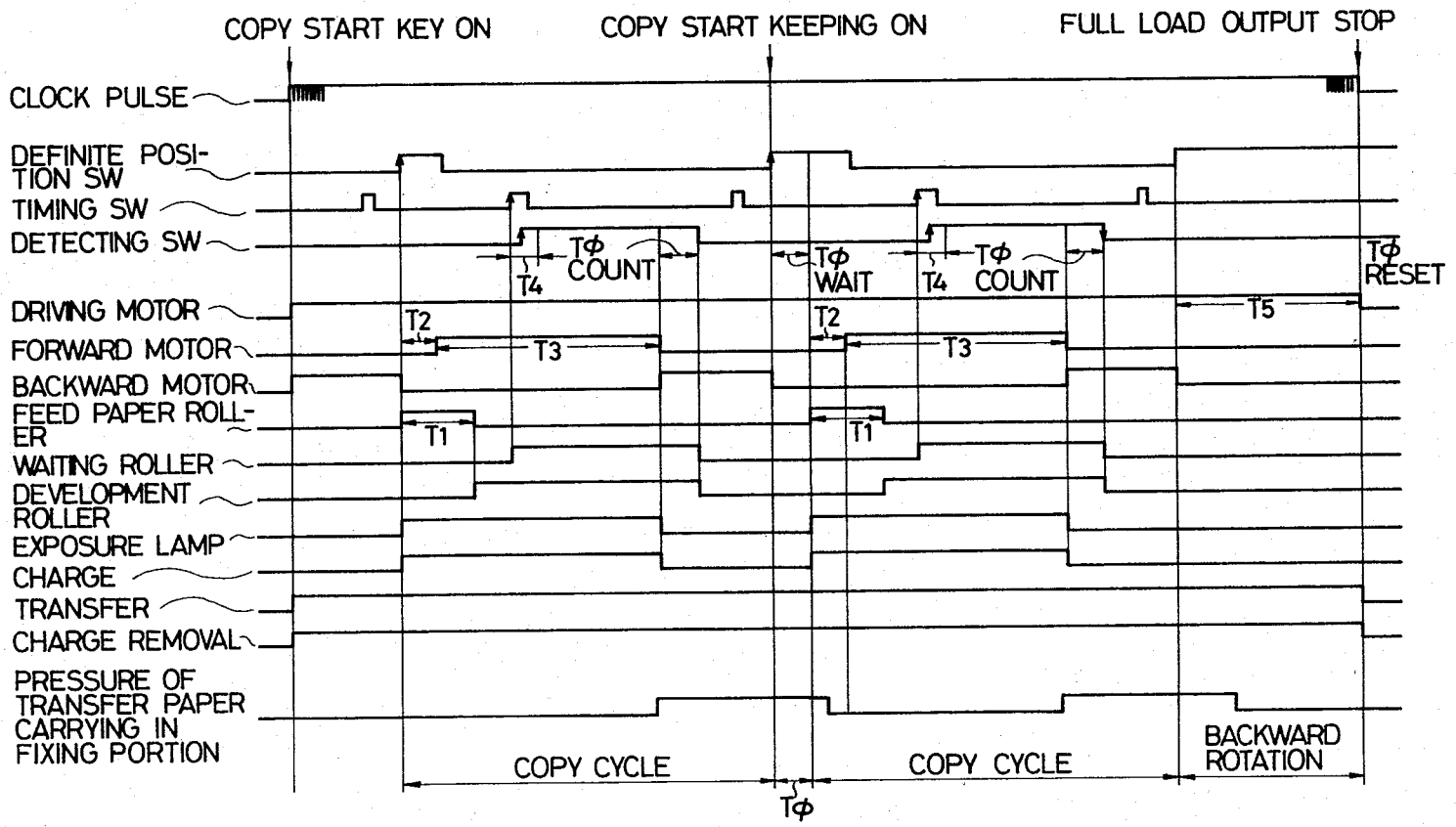
FIG. 4 is a timing chart of a copying machine operation according to the first embodiment of the present invention.

The microcomputer μCOM has a ROM which stores a program the flowchart whereof is shown in FIGS. 3A and 3B, and also performs signal processing and output operation, as shown in FIG. 4, according to the sequence of the flowchart.

The copying operation and the operation of the detecting function of a copying machine according to the first embodiment of the present invention will now be described with reference to the flowchart of FIGS. 3A and 3B and the timing chart of FIG. 4. Assume that in STEP 1, the copying machine is enabled for copying when it is set in the continuous copying mode. When the copy start switch 8 is depressed under this condition, the driving motor 23, the transfer charger 13 and the charge remover 16 are started. In STEP 2, the definite position switch 22 detects whether the original table 2 is located at a difinite position. If not, the forward/backward clutch 24 is started to move the original table 2 backward toward the predetermined position until the definite position switch 22 detects the original table 2. When the definite position switch 22 detects the original table 2, the forward/backward clutch 24 is stopped. In STEP 3, it is discriminated whether the timer Tϕ which serves as a copy prohibition timer in the present invention is set. However, this operation relates to a second or later copy in a case where the user requires more than two copies in the continuous copying mode. This case will be described in detail later. The first copy is being produced and the copy prohibition timer Tϕ is reset. Therefore, the feed paper roller 6 is started by starting a timer T1 which counts the ON-time thereof. A timer T2 which determines a timing for energizing the forward/backward clutch 24 is set, the exposure lamp 20 is lit up, and the charger 15 is started (STEP 4). Thereafter, in STEP 5, the forward/backward clutch 24 is energized when the timer T2 completes counting. This moves the original table 2 forward and a timer T3 is started which designates the ON-time of the forward/backward clutch 24. In STEP 6, when the timer T3 completes counting, the feed paper roller 6 is stopped and the development roller 6 is energized. The transfer paper sheet 14 supplied from the cassette 11 reaches the waiting rollers 5 and remains thereat. In STEP 7, the timing switch 21 is turned on in accordance with the forward movement of the original table 2. This starts rotation of the timing rollers 5 and restarts the feeding of the transfer paper sheet 14. A timer T4 provides a timing for the detection switch 10 to start detecting the transfer paper sheet 14. If the transfer paper sheet 14 is fed in a correct manner when the timer T4 completes counting, the detection switch 10 still detects the transfer paper sheet 14 and therefore is on. If the detection switch 10 does not detect the transfer paper sheet 14 even after the timer T4 completes counting or is over, it is either because the transfer paper sheet 14 has not been fed from the cassette 11, or the waiting rollers 5 are not feeding the paper correctly. In this case, it is determined that the transfer paper 14 has become jammed before it can reach the detection switch 10. The sequence enters jam processing. Output to all loads are disabled, an indicator lamp for indicating a JAM lights up, and the entire operation is stopped (STEP 8). If the transfer paper sheet 14 is detected in STEP 8, it is discriminated whether the timer T3 which serves as a forward clutch ON timer is over. If YES in STEP 9, the forward movement of the forward/backward clutch 24 is stopped and the backward movement thereof is started, and the exposure lamp 20 and the charger 15 are turned off in STEP 10. At this point, it is also checked whether the detection switch 10 detects the transfer paper sheet 14. If YES, the paper is regarded as a large-sized one and the copy prohibition timer Tϕ starts a timer set count. The copy prohibition timer Tϕ continues the timer set count until the detection switch 10 no longer detects the transfer paper sheet 14, that is, until the trailing edge of the transfer paper sheet 14 has passed over the detection switch 10. The detection switch 10 is turned 15 off when the trailing edge of the transfer paper sheet 14 has completely passed thereover. The timer set count of the copy prohibition timer Tϕ is stored in the RAM (not shown) in the microcomputer μCOM. The development roller 19 and the waiting rollers 5 are turned off. In STEP 11, the definite position switch 22 is checked until the original table 2 returns to the predetermined position. When it does, the definite position switch 22 is turned on and the backward movement of the forward/backward clutch 24 is stopped.

In STEP 12, it is discriminated whether the copying machine is in the continuous copying mode. If YES in STEP 12, the sequence returns to STEP 3 and the copying operation is restarted.

As in the manner described above, in STEP 3 of a copying operation for copying a second or later copy in the continuous copying mode, the state of the copy prohibition timer Tϕ is detected, which timer is set in accordance with the off state of the detection switch 10 upon the trailing edge detection of the transfer paper sheet 14. When the timer Tϕ is set, the copying machine remains in a waiting state until the timer Tϕ is over so as to prohibit a subsequent copying operation. Since the pressure/fixing rollers 4 feed out the transfer paper sheet 14 during the waiting state as shown in FIG. 4, any impact against the driving system occurs during a period in which the copying machine is not executing a copying operation. This prevents degradation of copy quality. When the copy prohibition timer Tϕ is over, the sequence advances to STEP 4 and to subsequent steps thereafter. The steps proceed according to the copying cycle described above. Therefore, waiting time T0 is prolonged if the timer set count of the timer Tϕ increases, in other words, if the transfer paper sheet 14 is of a large size.

In the last copy cycle of the continuous copying mode, a timer T5 for backward rotation is set in STEP 12. The driving motor 23, the transfer charger 13 and the charge remover 16 are turned off when the timer T5 is over, and the copy prohibition timer Tϕ is reset to complete the copying operation.

The timing operation of each timer is performed by counting pulses supplied to the μCOM microcomputer from the drum clock generator 25. When a timer is set, it indicates that a predetermined count is set in the RAM from the ROM.

As described above, according to the present invention, a copying machine is provided wherein, even if an impact occurs to the driving system, it does not adversely affect the quality of a copy, and the reliability of the copying machine is increased due to its simple configuration.

Even if the driving system is applied to the transfer charger 13 and the separation mechanism 12, inconvenience from a impact applied to the driving system can be prevented in the same manner. The same result can be obtained even if a size signal producing means produces a size signal by detecting a size of the transfer paper stored in the cassette or a key size signal in response to a paper size designation made by an operator. Even if transfer paper sheets of the same size are used or continuous copying operations are repeatedly performed with shorter time intervals, good results can be obtained by performing copy start control in the same manner as described above.

Figure 5:
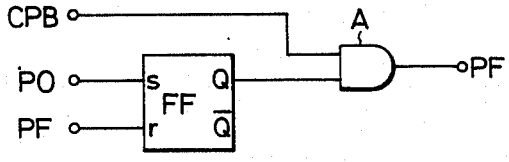
FIG. 5 is a circuit diagram of a copying machine according to a second embodiment of the present invention.

FIG. 5 shows a second embodiment of the present invention, wherein an image formation of a next copying cycle is not allowed to start until it is detected that a transfer of the present cycle is completed. An image forming apparatus according to this second embodiment prevents transfer blurs to the maximum extent, and is specially applicable for a compact copying machine.

Referring to FIG. 5, a signal PO goes to logic level "1" after a transfer paper sheet 14 has completely passed over a transfer paper sensor 100 provided on a path of the transfer paper sheet 14 after separation from the surface of a photosensitive drum. A signal CPB goes to logic level "1" in response to depression of a manual copy start switch. A signal PF drives a feed paper roller 6. A flip-flop FF is set in response to the signal PO so as to produce a signal of logic level "0" from a terminal Q and is reset in response to the signal PF so as to produce a signal of logic level "1" therefrom. An AND gate A controls a copy start or a possibility thereof. In other words, while the transfer paper sheet is passing over the sensor 100, an output from the terminal Q of the flip-flop is kept at logic level "0". Thus, even if the manual copy start switch is depressed, the transfer paper sheet for the next copying cycle is not fed. When the transfer paper sheet has completely passed over the sensor 100, the output from the terminal Q goes to logic level "1" and is kept at that level. Accordingly, when the manual copy start switch is depressed, the signal PF is produced and the transfer paper is fed. Note that the signal CPB is kept at logic level "1" after the manual copy start switch is once depressed. If the manual copy start switch is depressed while the transfer paper is still passing over the sensor 100, transfer paper feeding is started automatically when the current transfer paper sheet passed over the sensor 100. The sensor 100 can be designed to operate in response to a timer which is set by a detection switch 10 upon detection of the transfer paper sheet. If an original table is designed such that a moving direction (forward/backward) thereof is switched in response to the output from the terminal Q, a transfer blur due to the direction switching of the original table can be prevented.

What I claim is:

1. An image forming apparatus comprising;

means for transporting a sheet;

processing means for forming an image on the sheet;

size signal producing means for producing a signal corresponding to the size of the sheet; and means for controlling said processing means so as to prevent the start of a next image forming cycle until the sheet is transported beyond a predetermined processing member of said processing means when said size signal indicates a predetermined size.

2. An apparatus according to claim 1, wherein said size signal producing means produces said size signal by detecting the size of the sheet.

3. An apparatus according to claim 1, wherein said size signal producting means also detects a jam of the sheet being transported by said transporting means.

4. An image forming apparatus comprising:

processing means for forming an image on a transfer medium;

a treatment member which is provided on a conveying path of the transfer medium, a drive of the number being controlled to treat the transfer medium; and means for preventing a next image forming cycle until the transfer medium has passed over said treatment member.

5. An apparatus according to claim 4, wherein said treatment member comprises means for fixing an image on the transfer medium under pressure.

6. An apparatus according to claim 4, wherein the next image forming cycle is started in response to completion of a passing of the image transfer medium.

7. An apparatus for forming an image on a rotatable member and transferring the image onto a transfer medium, comprising image forming means, detecting means for detecting completion of a transfer, and controlling means for controlling said image forming means by said detecting means so that the apparatus is prohibited from starting to form a next image before completion of the transfer is detected.

8. An apparatus for forming an image on a rotatable member and transferring the image onto a transfer medium, comprising scanning means utilized for image forming, detecting means for detecting completion of a transfer and means for prohibiting a switching of operation of said scanning means before completion of the transfer is detected.

9. An apparatus according to claim 1, wherein said predetermined processing member comprises means for fixing the image formed on the sheet.

10. An apparatus according to claim 9, wherein said fixing means fixes the image by applying a force.

11. An apparatus according to claim 1, wherein said processing means includes means for scanning an original and wherein a scanning distance of said scanning means is constant irrespective of the sheet size.

12. An apparatus according to claim 1, wherein said control means enables said processing means to start the next image forming cycle after the sheet is transported beyond the predetermined processing member.

* * * * *

UNITED STATES PATENT AND TRADEMARK OFFICE

CERTIFICATE OF CORRECTION

PATENT NO. : 4,613,227

DATED : September 23, 1986

INVENTOR(S) : TAKESHI HONJO

It is certified that error appears in the above-identified patent and that said Letters Patent is hereby corrected as shown below:

AT [57] IN THE ABSTRACT

Line 8, "TO" should read --Tϕ--.

COLUMN 1

Line 21, "as" should read --an--.

COLUMN 2

Line 27, "phtotosensitive" should read --photosensitive--.

COLUMN 3

Line 43, "difinite" should read --definite--.

COLUMN 4

Line 36, delete "15".

UNITED STATES PATENT AND TRADEMARK OFFICE

CERTIFICATE OF CORRECTION

PATENT NO. : 4,613,227

DATED : September 23, 1986

INVENTOR(S) : TAKESHI HONJO

It is certified that error appears in the above-identified patent and that said Letters Patent is hereby corrected as shown below:

COLUMN 6

Line 22, "producting" should read --producing--.
Line 30, "number" should read --member--.

Signed and Sealed this

Twenty-fourth Day of February, 1987

*Attest:*

DONALD J. QUIGG

*Attesting Officer*

*Commissioner of Patents and Trademarks*